US010583546B2

(12) United States Patent
Yang

(10) Patent No.: US 10,583,546 B2
(45) Date of Patent: Mar. 10, 2020

(54) REMOVAL TOOL

(71) Applicant: Jen-Yung Yang, Taichung (TW)

(72) Inventor: Jen-Yung Yang, Taichung (TW)

( * ) Notice: Subject to any disclaimer, the term of this patent is extended or adjusted under 35 U.S.C. 154(b) by 154 days.

(21) Appl. No.: 15/909,214

(22) Filed: Mar. 1, 2018

(65) Prior Publication Data

US 2019/0224822 A1 Jul. 25, 2019

(30) Foreign Application Priority Data

Jan. 24, 2018 (TW) ..... 107102583 A

(51) Int. Cl.
*B25B 27/06* (2006.01)
*B25B 27/02* (2006.01)

(52) U.S. Cl.
CPC ..... *B25B 27/062* (2013.01); *B25B 27/023* (2013.01)

(58) Field of Classification Search
CPC ... B25B 27/00; B25B 27/0035; B25B 27/062; B25B 27/023
See application file for complete search history.

(56) References Cited

U.S. PATENT DOCUMENTS 1,494,131 A * 5/1924 Renftle ..... B25B 27/023 29/217
3,736,816 A * 6/1973 McAfee ..... B25B 27/0035 81/484
5,586,378 A * 12/1996 Smith ..... B25B 27/023 269/249
5,781,977 A * 7/1998 Servones ..... B25B 27/023 29/259
5,906,034 A * 5/1999 Weisshaar ..... B25B 27/023 269/93
6,129,339 A * 10/2000 Lundgreen ..... B25B 27/304 254/10.5
2012/0174388 A1* 7/2012 Shen ..... B25B 27/062 29/724

(Continued)

*Primary Examiner* — Tyrone V Hall, Jr.
(74) *Attorney, Agent, or Firm* — Guice Patents PLLC

(57) ABSTRACT

The present invention provides a removal tool. A base portion is used as a base, and a first component and a second component are separately disposed on the base portion in a manner of being isolated from each other, so that a relative distance between the first component and the second component can be changed under the effect of an external first external force, to enable a vehicle maintainer to perform removal work of separating a ball joint of a lower support arm of a vehicle from a combined bushing. The technical features of the present invention further include a first acting portion, a second acting portion, and a third acting portion respectively disposed on the first component and the second component. The first acting portion and the second acting portion are disposed on a same component, and the first component is enabled to change relative positions of the first component and the second component under the effect of an external second external force, so that relative positions among the first acting portion, the second acting portion, and the third acting portion are changed. As such, the vehicle maintainer can choose the first acting portion and the second acting portion or choose the first acting portion and the third acting portion according to an actual requirement, to adapt to requirements of different conditions of removal work.

16 Claims, 9 Drawing Sheets

(56) References Cited

U.S. PATENT DOCUMENTS

| | | | | |
|---|---|---|---|---|
| 2012/0204393 | A1* | 8/2012 | Gentner | B25B 27/0035 29/257 |
| 2014/0059824 | A1* | 3/2014 | Hao | B25B 27/0035 29/256 |
| 2019/0009397 | A1* | 1/2019 | Wallman | B25B 27/0035 |

* cited by examiner

REMOVAL TOOL

BACKGROUND OF THE INVENTION

1. Field of the Invention

The present invention relates to automotive maintenance tools, and in particular, to a removal tool.

2. Description of the Related Art

A replaceable ball joint removal tool is disclosed in the prior art ROC patent No. 1373398. By using a movable and replaceable clamping member, an operator can adapt to requirements of different ball joint specifications to replace a clamping member having a corresponding size, to provide convenience to the operator.

In the removal tool disclosed in the foregoing published prior art patent, a replaceable clamping member can be used to extend the applicability of the ball joint removal tool. However, during the operation of replacing a clamping member, an original clamping member needs to be removed first before a clamping member having a different size can be clamped on the body of the tool again. Therefore, there is still no simple operation of replacing different clamping members.

SUMMARY OF THE INVENTION

Therefore, a main objective of the present invention is to provide a removal tool, so that insertion bodies having different sizes can be replaced in a simple manner, to facilitate removal work.

In view of this, to achieve the foregoing objective, in the removal tool provided in the present invention, a base portion is used as a base, and a first component and a second component are separately disposed on the base portion in a manner of being isolated from each other, so that a relative distance between the first component and the second component can be changed under the effect of an external first external force, to enable a vehicle maintainer to perform removal work of separating a ball joint of a lower support arm of a vehicle from a combined bushing. The technical features of the present invention further include a first acting portion, a second acting portion, and a third acting portion respectively disposed on the first component and the second component. The first acting portion and the second acting portion are disposed on a same component, and the first component is enabled to change relative positions of the first component and the second component under the effect of an external second external force, so that relative positions among the first acting portion, the second acting portion, and the third acting portion are changed. As such, the vehicle maintainer can choose the first acting portion and the second acting portion or choose the first acting portion and the third acting portion according to an actual requirement, to adapt to requirements of different conditions of removal work.

The first acting portion and the second acting portion can be disposed on the first component or disposed on the second component, and correspondingly the third acting portion is disposed on the second component or disposed on the first component.

The first component can displace reciprocally under the first external force, to reduce or increase the distance between the first component and the second component. A direction in which the first component displaces may be a reciprocal linear movement or a pivotal movement with a rotation axis as the center.

To enable the first component to displace linearly reciprocally, the base portion may have a column body, and the first component is slidably disposed on the column body, so that the first component can displace reciprocally in a column axis direction of the column body.

To enable a transmission portion to transfer the first external force to the first component to drive the first component to make a reciprocal movement, the base portion may further include a sliding space provided in the column body, and two guide holes that are coaxial with each other are connected to the sliding space and are separately disposed on two sides of the column body in a symmetrical manner, so that the transmission portion is slidably disposed in the sliding space, and two abutting ends of the transmission portion respectively protrude from the guide holes to abut the first component.

Moreover, to keep the relative distance between the first component and the second component, an elastic portion needs to be disposed between the first component and the second component, and is used to provide an elastic force to elastically keep the first component and the second component in a state of being isolated from each other.

In addition, a power source of the first external force can be provided by a driving portion, to enable the driving portion to use a power output shaft to drive, via the transmission portion, the first component to displace.

The driving portion has a first bolt, an end of the first bolt passes through the sliding space and is combined with a wall of the sliding space in a screwing manner, and the power output shaft protrudes from the end of the first bolt. A second bolt is coaxially screwed in the other end of the first bolt, and the second bolt uses a hydraulic component disposed inside the first bolt to push the power output shaft to make an axial movement relative to the first bolt.

DETAILED DESCRIPTION OF THE PREFERRED EMBODIMENTS

Figure 1:
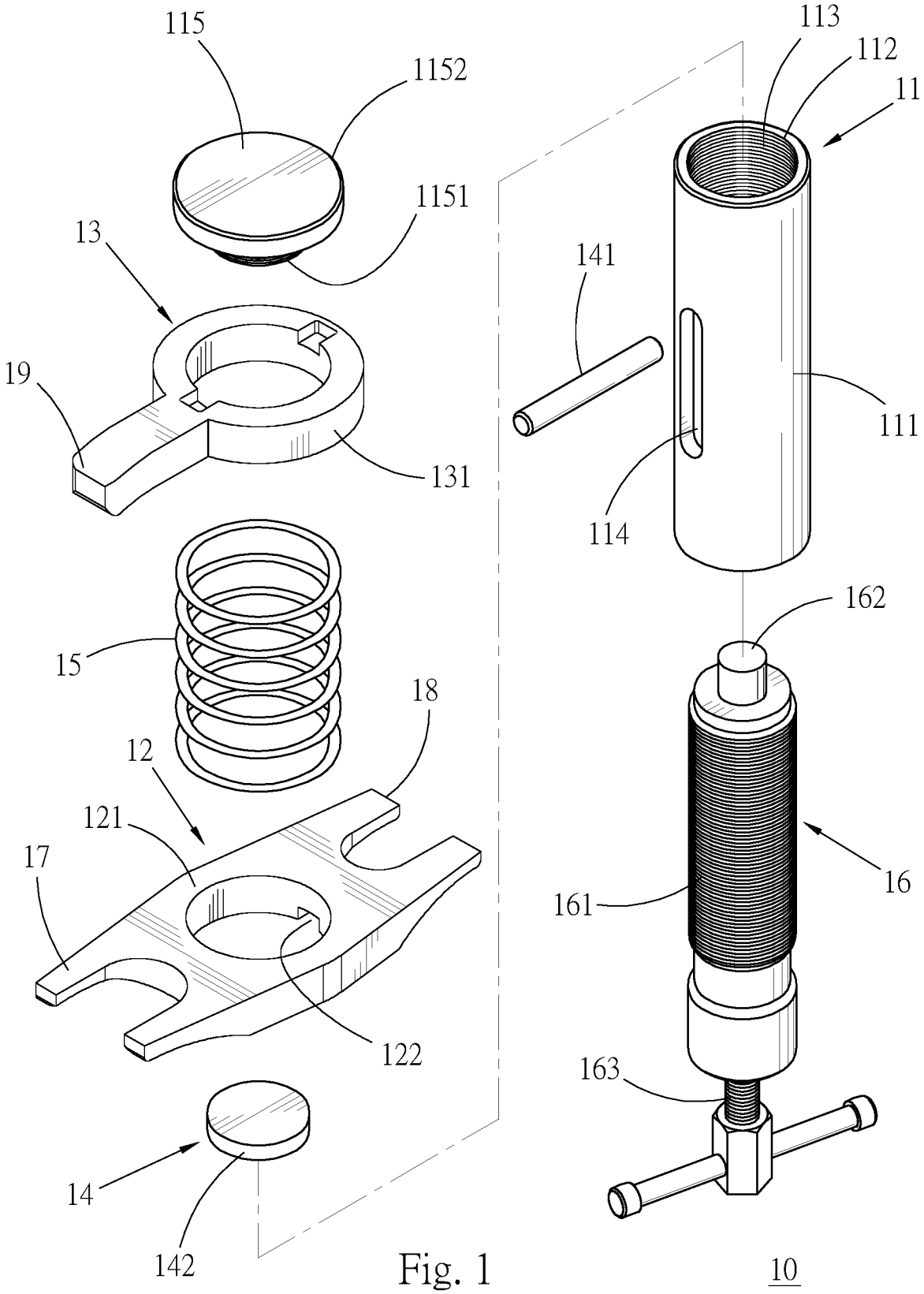
FIG. 1 is a three-dimensional exploded view according to a first preferred embodiment of the present invention.
Figure 2:
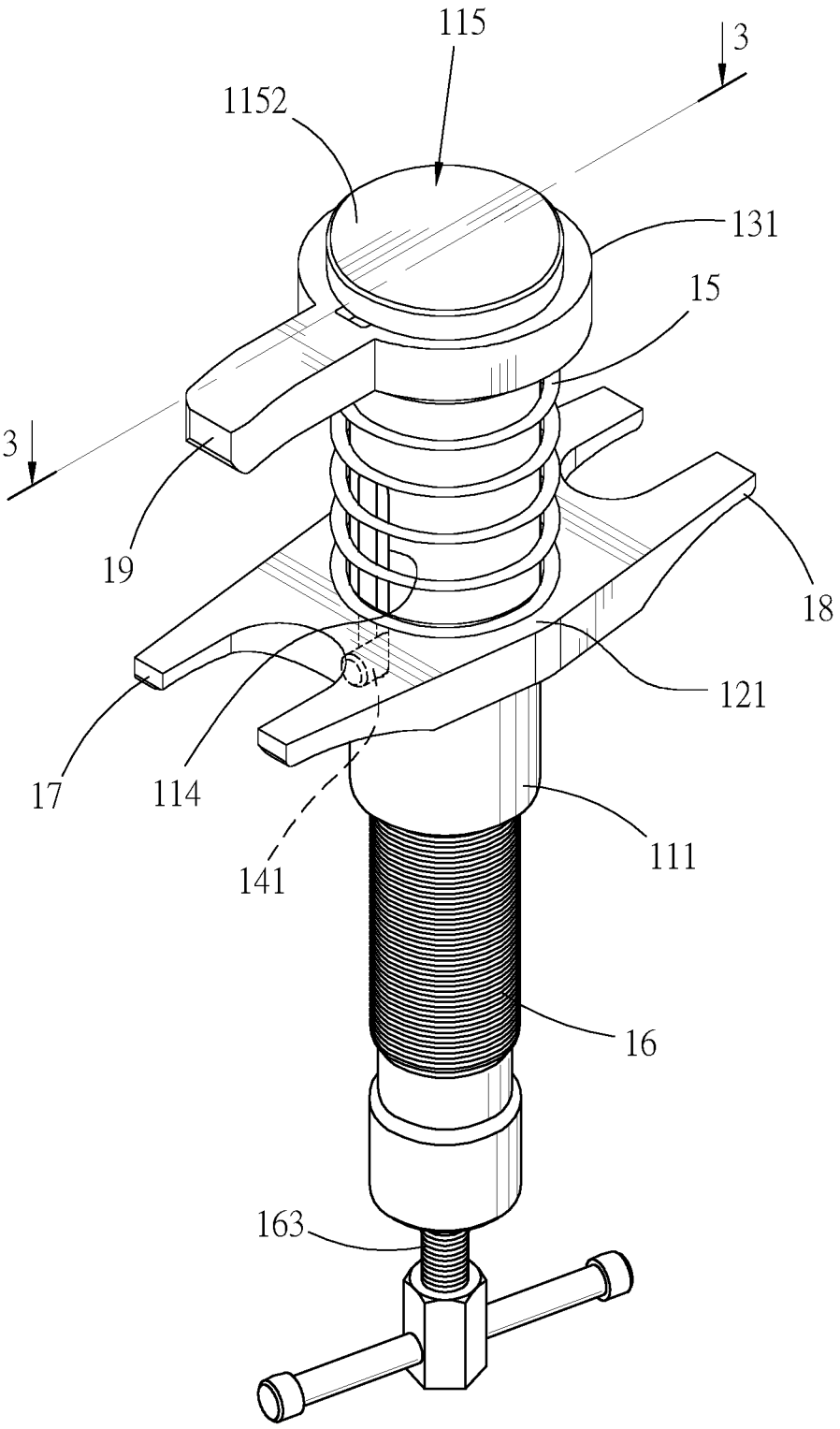
FIG. 2 is a three-dimensional combination view according to the first preferred embodiment of the present invention.
Figure 3:
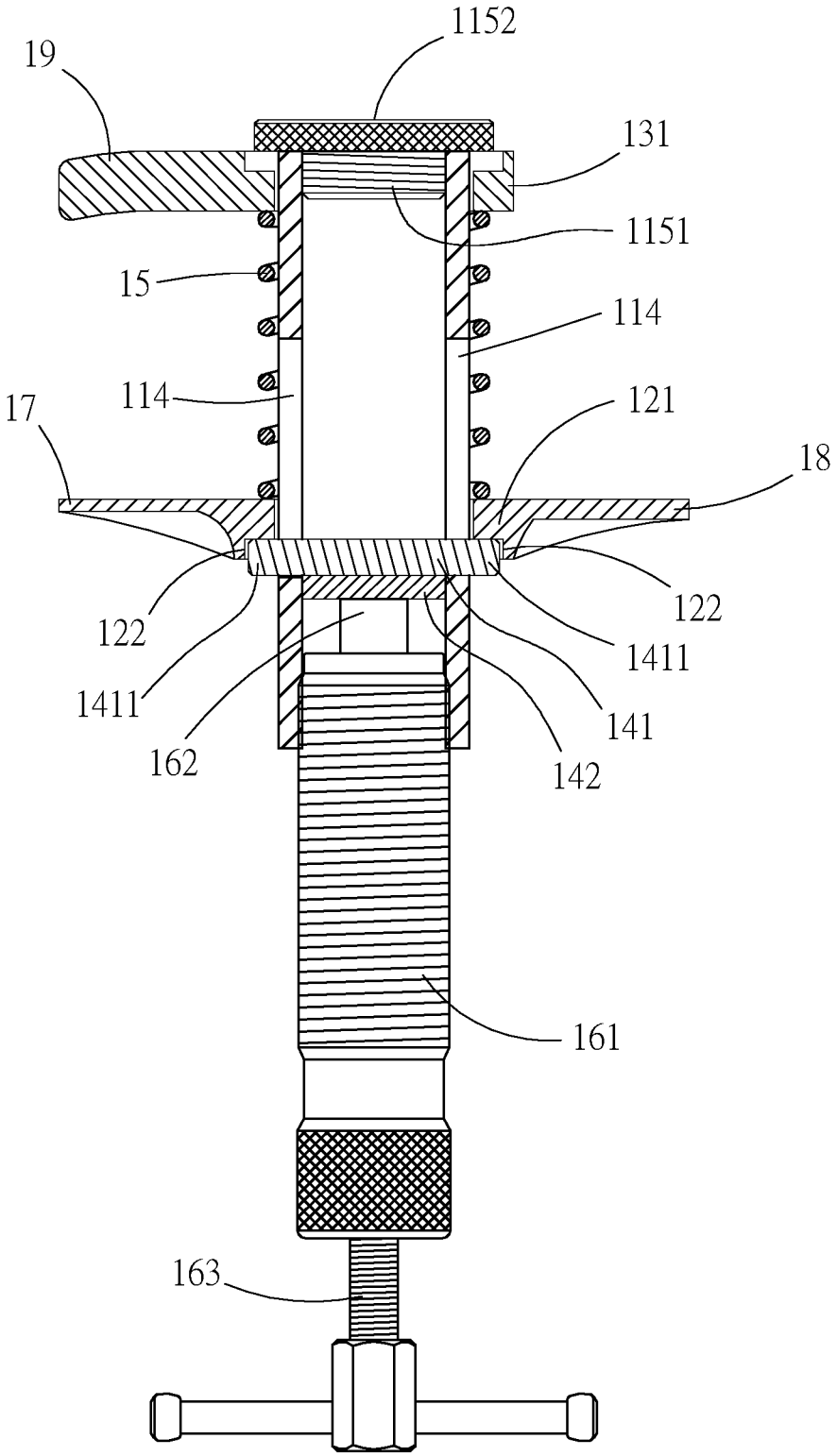
FIG. 3 is a sectional view along a sectional line 3-3 in FIG. 2 according to the first preferred embodiment of the present invention.
Figure 4:
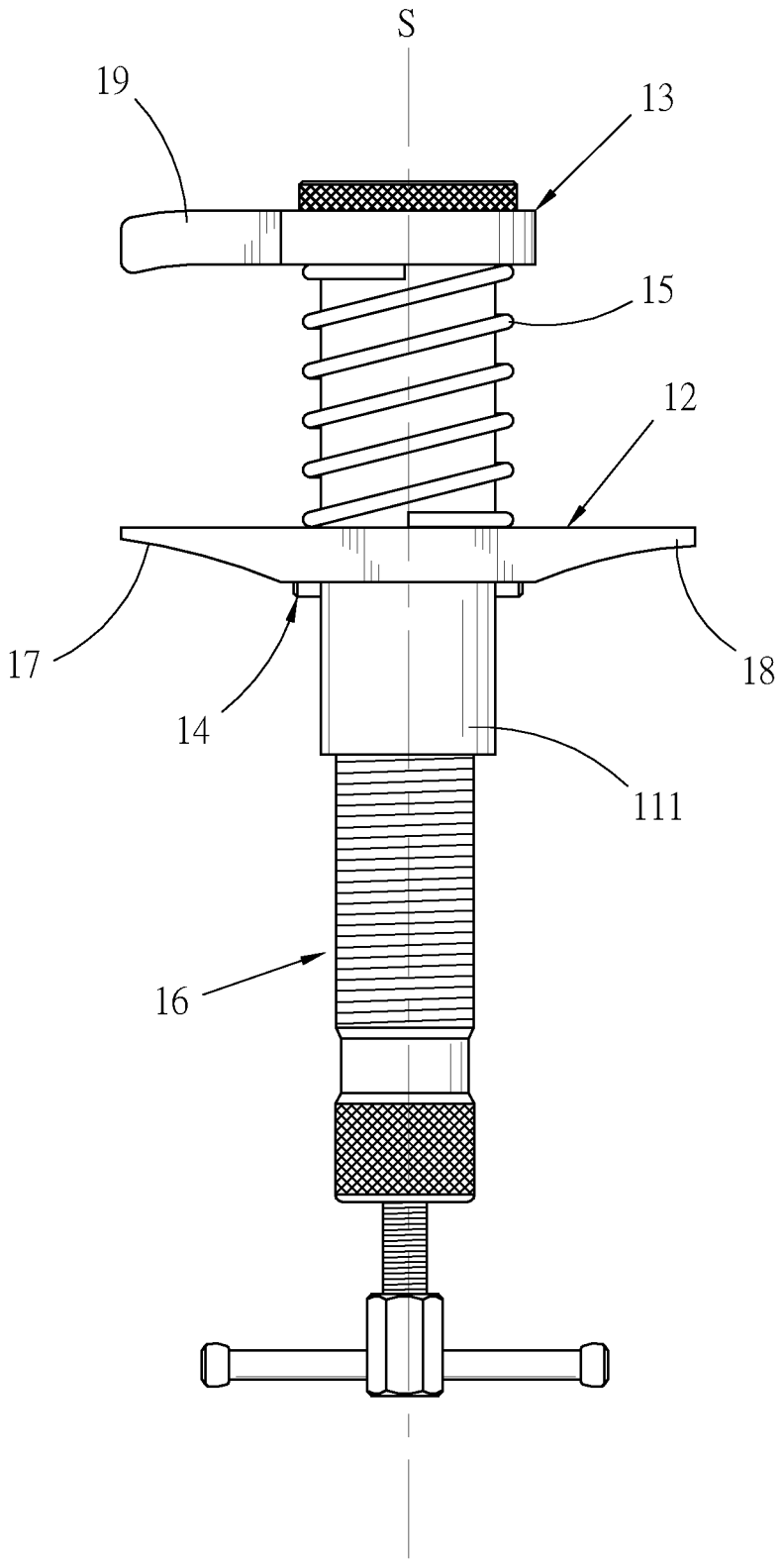
FIG. 4 is a plane view according to the first preferred embodiment of the present invention.

First, referring to FIG. 1 to FIG. 4, a removal tool (10) provided in a first preferred embodiment of the present invention mainly includes a base portion (11), a first component (12), a second component (13), a transmission portion (14), an elastic portion (15), a driving portion (16), a first acting portion (17), a second acting portion (18), and a third acting portion (19).

The base portion (11) has a cylindrical column body (111). A sliding space (112) extends through two ends of the column axis of the column body (111) along a column axis of the column body (111). A thread (113) is disposed on a wall of the sliding space (112). A pair of guide holes (114) are separately disposed on two sides of the column body (111) in a coaxial manner, and extend by a suitable length along the column axis of the column body (111) in a manner of being connected to the sliding space (112). A columnar seal body (115) is coaxially located at an end of the column axis of the column body (111). An end (1151) of the seal body (115) is inserted in the sliding space (112) and is screwed to the thread (113). An outer diameter of the other end (1152) of the seal body (115) is greater than an outer diameter of the column body (111).

The first component (12) has an annular first seat body (121) and is slidably sleeved on the column body (111), so that the first component (12) can displace reciprocally along the column axis of the column body (111). Two insertion grooves (122) are separately provided on an annular surface on a same side of the first seat body (121) in a symmetrical manner.

The second component (13) also has a structure similar to that of the first component (12), that is, has an annular second seat body (131) and is coaxially sleeved on the column body (111), so that the second component (13) can also displace reciprocally in a column axis direction of the column body (111).

The transmission portion (14) has a slide rod (141) slidably disposed in the sliding space (112). Two ends of a rod shaft respectively protrude outside the base portion (11) from the guide holes (114) to form two abutting ends (1411). The two abutting ends (1411) are respectively inserted in the insertion grooves (122). A slider (142) is slidably disposed in the sliding space (112), and is adjacent to the rod body of the slide rod (141).

The elastic portion (15) is a spring, is sleeved on the column body (111), is located between the first component (12) and the second component (13), and is used to provide an elastic force to elastically keep the first component (12) and the second component (13) in a state of being isolated from each other. The provided elastic force at the same time enables the first component (12) to keep the abutting ends (1411) in a state of being inserted in the insertion grooves (122), and keeps the second component (13) in a state of being far away from the first component (12) and abutting the other end (1152) of the seal body (115).

The driving portion (16) is a conventional hydraulic rod disclosed in the ROC patent No. M287729. The driving portion (16) structurally has a first bolt (161). An end of the first bolt (161) extends into the sliding space (112) from the other end of the column body (111), and is screwed to the thread (113) with a circumference. A power output shaft (162) protrudes from the end of the first bolt (161) and abuts the slider (142). A second bolt (163) is coaxially screwed in the first bolt (161) and is used to apply a first external force to the transmission portion (14) via a hydraulic component (not shown) disposed inside the first bolt (161) and the power output shaft (162).

The first acting portion (17) and the second acting portion (18) are fork-shaped bodies having similar shapes but different sizes, are separately disposed on the first component (12) with forking directions of the first acting portion (17) and the second acting portion (18) opposite each other, and are integrally formed with the first component (12).

The third acting portion (19) is a sheet-shaped blocking body, is protrusively disposed on a side of the second component (13), and is integrally formed with the second component (13).

In the foregoing composition, the second component (13) is elastically positioned in a position abutting the seal body (115) under the effect of the elastic force of the elastic portion (15), so that the third acting portion (19) integrally formed on the second component (13) also protrudes outside the base portion (11) in a positioned manner instead of having a randomly changing position.

The first component (12) displaces linearly reciprocally with the column axis of the column body (111) as a virtual movement axis (s), and in addition, rotates in a direction perpendicular to the virtual movement axis (s), to move between a first position and a second position. When the first component (12) is located in the first position, the first acting portion (17) and the third acting portion (19) are located on a same side of the column body (111), and the first acting portion (17) and the third acting portion (19) are also located in a direction parallel to an axial direction of the virtual movement axis (s). When the first component (12) is located in the second position, the second acting portion (18) and the third acting portion (19) are located on a same side of the column body (111), and the second acting portion (18) and the third acting portion (19) are located in a direction parallel to the axial direction of the virtual movement axis (s). As such, a vehicle maintainer can adapt to structural differences of different models to choose to enable the first component (12) to be located in the first position or the second position, to facilitate maintenance work.

Figure 5:
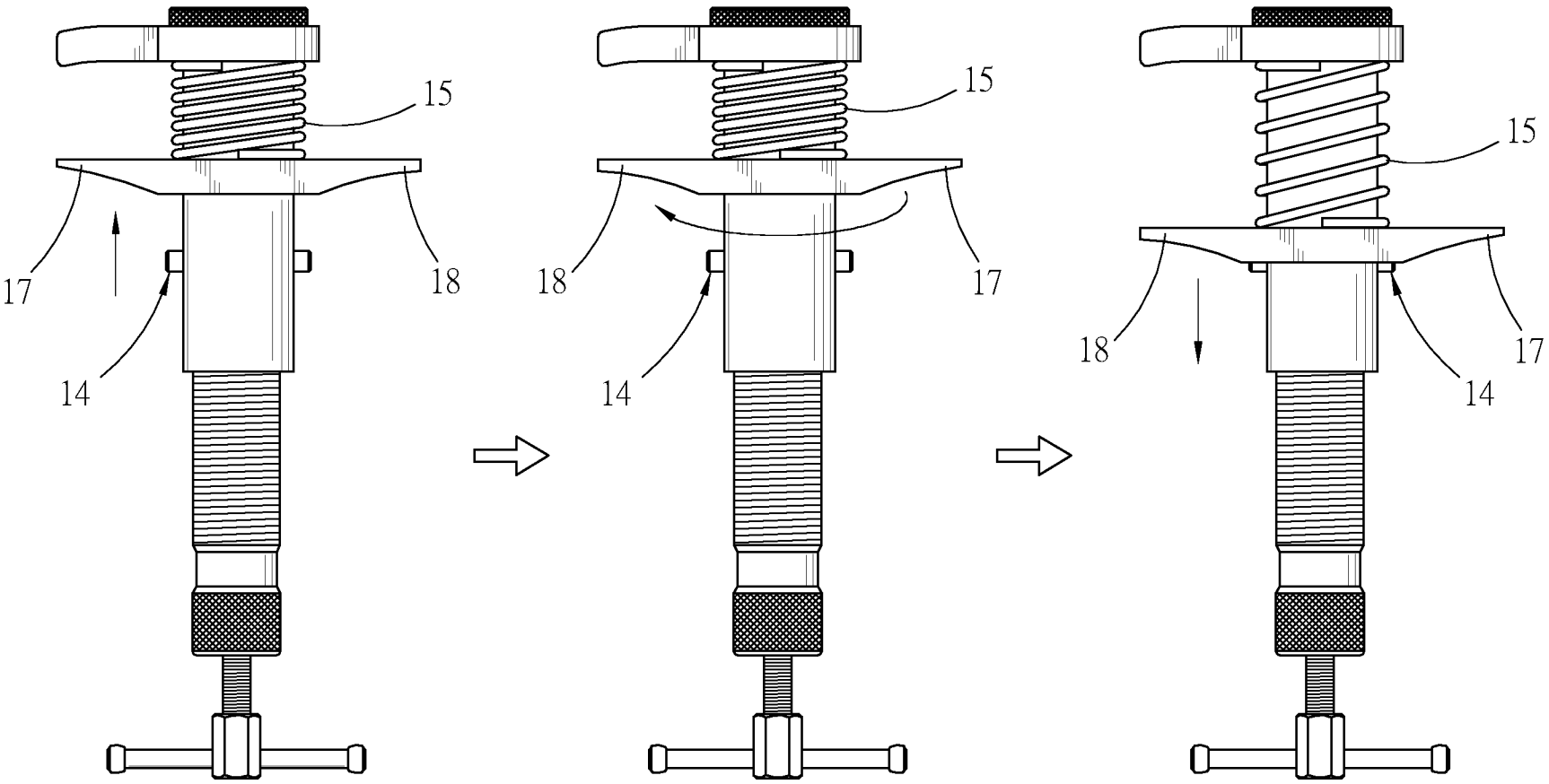
FIG. 5 is a schematic showing an operation of changing positions of components according to the first preferred embodiment of the present invention.

Regarding the operation of changing the first component (12) to be in the first position or the second position, an operator can directly apply a force as shown in FIG. 5 without the help of an external tool, to push the first component (12) and compress the elastic portion (15) to move along the virtual movement axis (s), so that the abutting ends (1411) are detached from the insertion grooves (122). In this way, the first component (12) is no longer restricted by the slide rod (141). A second external force is then applied to drive the first component (12) to rotate, to adjust the position of the first component (12) to be the first position or the second position. After adjustment is completed, the operator only needs to release the applied pushing force. The first component (12) can move and restore along the virtual movement axis (s) under the effect of the elastic force of the elastic portion (15), so that the abutting ends (1411) are inserted in the insertion grooves (122) again, to restrict the rotation of the first component (12).

Figure 6:
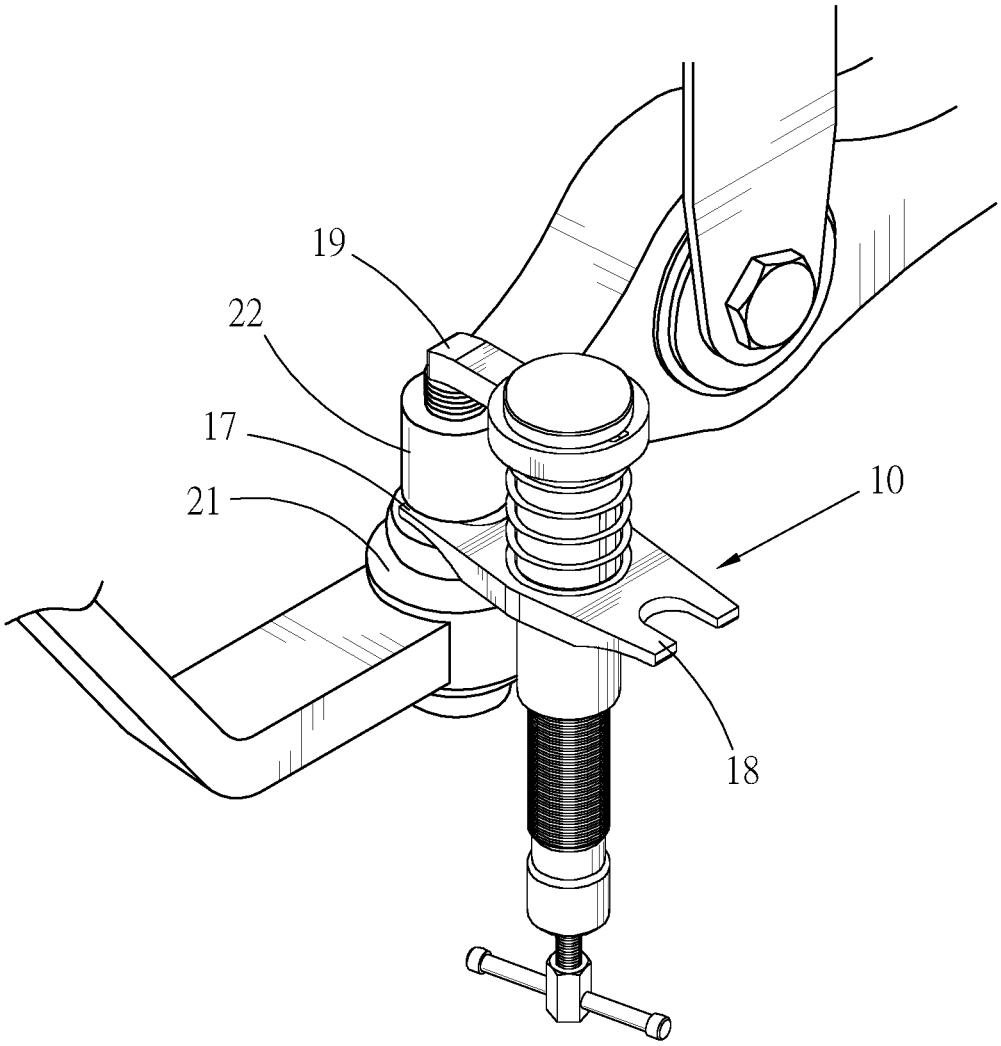
FIG. 6 is a schematic use diagram according to the first preferred embodiment of the present invention.

As such, during use of the removal tool (10), as shown in FIG. 6, according to the position of the first component (12), the first acting portion (17) or the second acting portion (18) is inserted between a ball joint (21) and a bushing (22), and the third acting portion (19) abuts a rod end of a shaft rod of the ball joint. In this embodiment, for example, the first component (12) is located in the first position. The first acting portion (17) is inserted between the ball joint (21) and the bushing (22), and the third acting portion (19) is pressed on a shaft rod of the ball joint (21). Next, the driving portion (16) applies the first external force, to reduce a distance between the first acting portion (17) and the third acting portion (19), so that the ball joint (21) is separated from the bushing (22), to facilitate maintenance work.

In efficacy, the removal tool (10) can adapt to requirements of different working conditions by simply changing the position of the first component (12). Complex operations in the prior art are avoided, and different and independent replacement components that need to be prepared and used in the prior art to adapt to requirements of different working conditions are no longer needed. The specific efficacy of simple operations is achieved. Moreover, by changing a screwing depth of the first bolt (161) in the base portion (11), a dead point position of the first component (12) in the reciprocal displacement can be rapidly changed, to facilitate operation.

Figure 7:
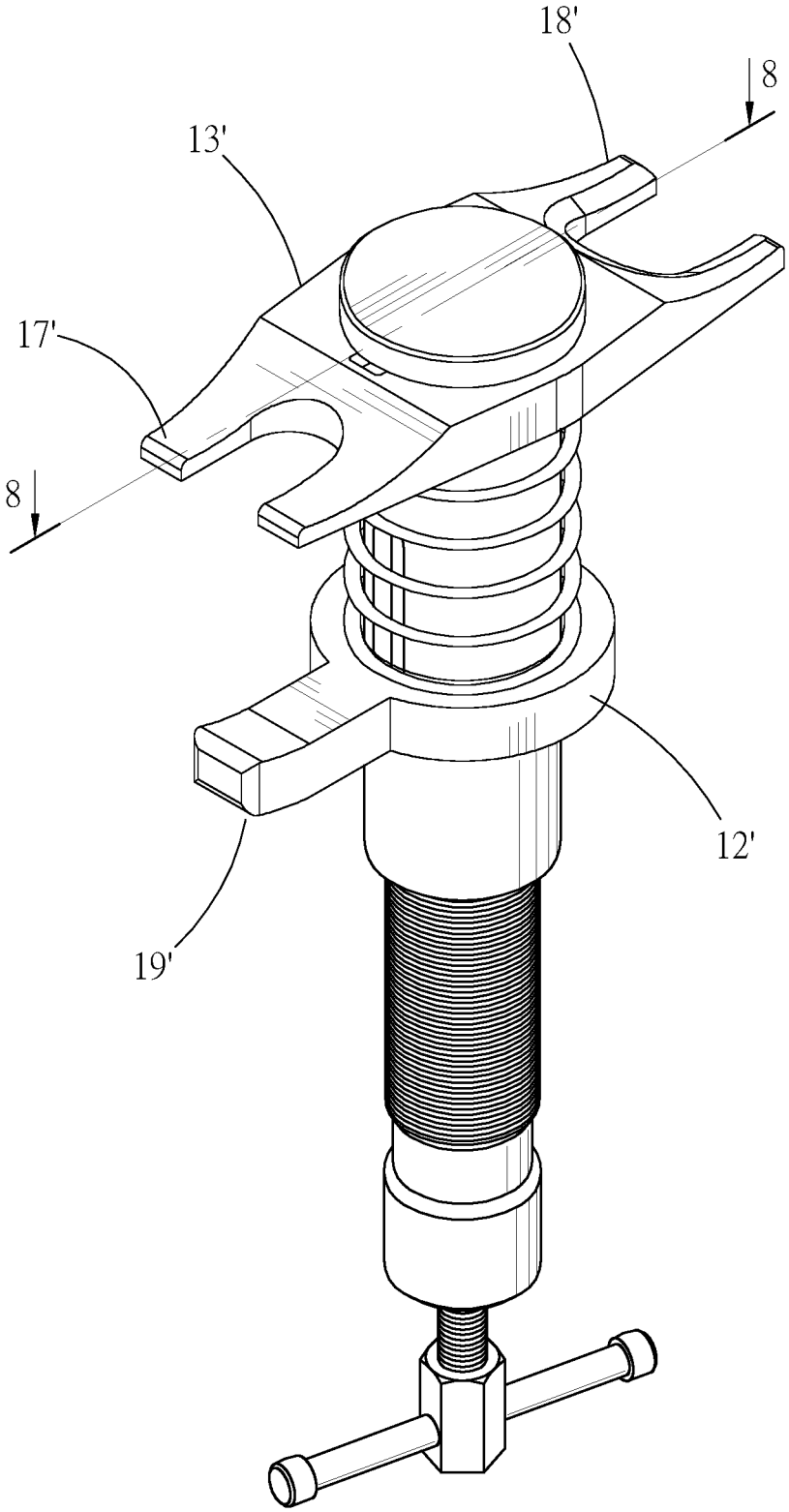
FIG. 7 is a three-dimensional combination view according to a second preferred embodiment of the present invention.
Figure 8:
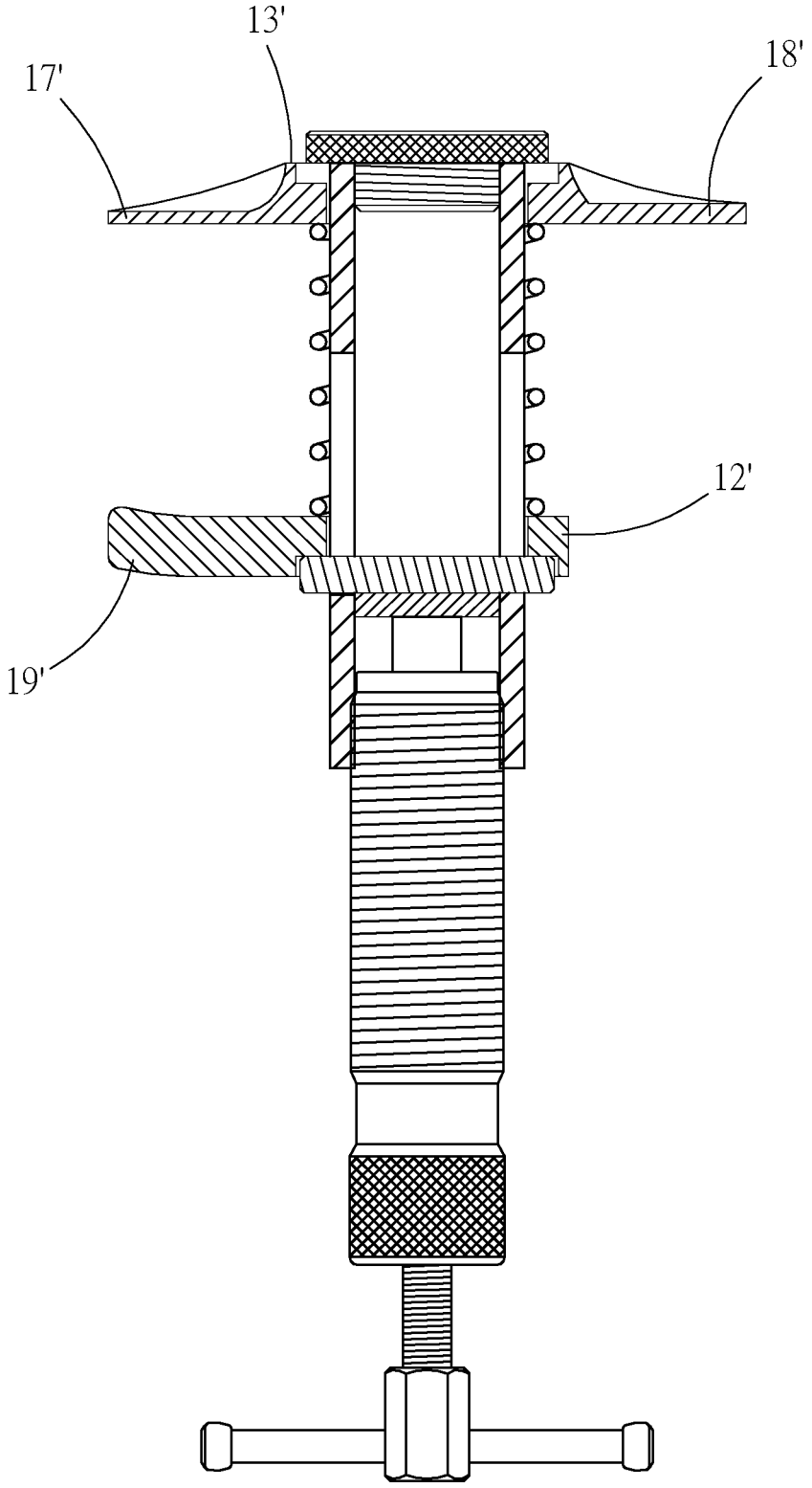
FIG. 8 is a sectional view along a sectional line 8-8 in FIG. 7 according to the second preferred embodiment of the present invention.
Figure 9:
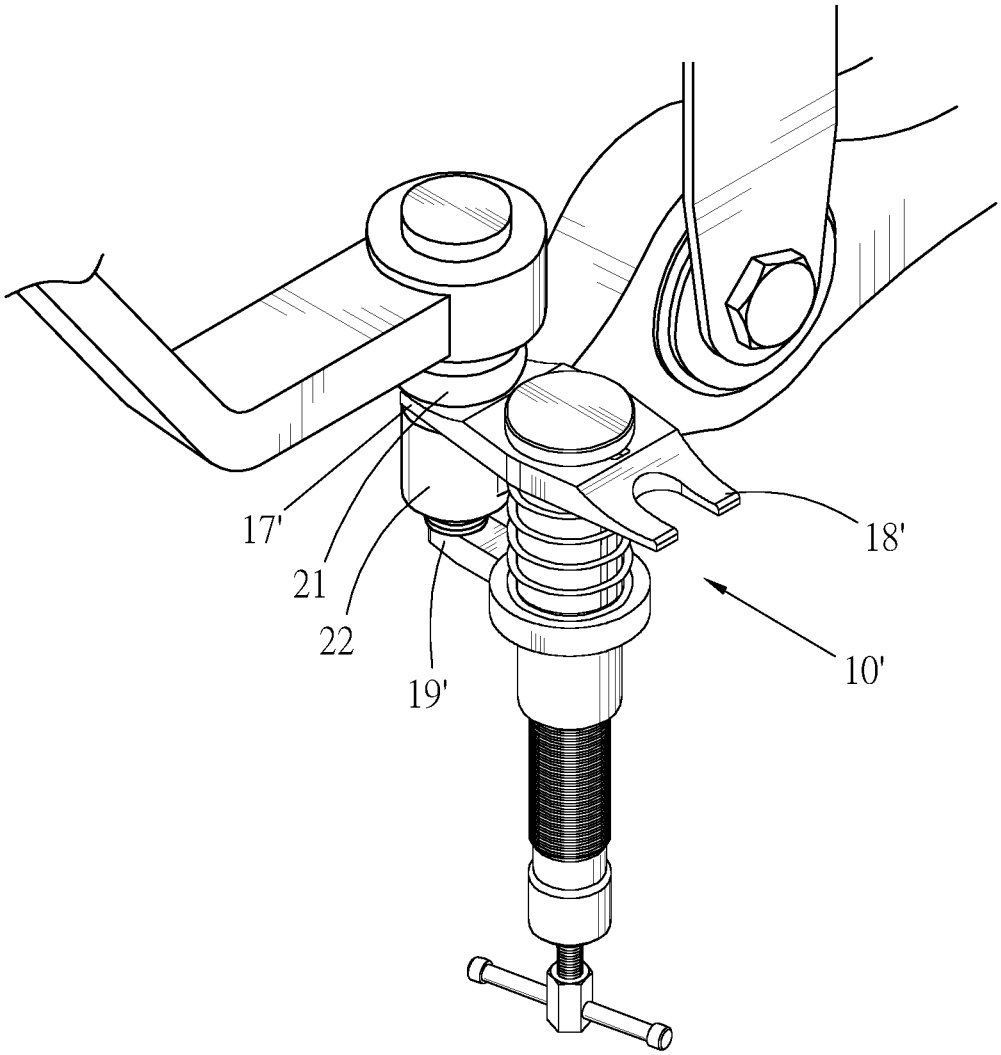
FIG. 9 is a schematic use diagram according to the second preferred embodiment of the present invention.

Moreover, because structural differences of vehicles include size differences and compositional differences, during implementation, there may also be component subjects in which the first acting portion, the second acting portion, and the third acting portion are differently disposed. In a second preferred embodiment shown in FIG. 7 and FIG. 8, in a removal tool (10'), a third acting portion (19') is disposed on a first component (12'), and a first acting portion (17') and a second acting portion (18') are disposed on a second component (13'), to perform maintenance work that is shown in FIG. 9 and is similar to that in FIG. 6.

It should be particularly noted that the integrally formed first component (12') and third acting portion (19') disclosed in the second preferred embodiment are in fact the integrally formed second component (13) and third acting portion (19) disclosed in the first preferred embodiment. Correspondingly, the integrally formed second component (13') and first acting portion (17') and the second acting portion (18') disclosed the second preferred embodiment are also in fact the integrally formed first component (12) and first acting portion (17) and the second acting portion (18) disclosed in the first preferred embodiment. In other words, the content disclosed in the second preferred embodiment is obtained by only interchanging positions of corresponding members in the first preferred embodiment. To achieve such efficacy of interchangeable positions, the first component and the second component need to be removable and movable relative to the base portion, and in addition, the second component (13) in the first preferred embodiment needs to have an insertion groove structure as disclosed in the second preferred embodiment. In this way, when the positions of the first component and the second component are interchanged, the abutting ends can still be inserted in the insertion groove structure.

REFERENCE NUMERALS (10) (10') Removal tool (11) Base portion (111) Column body (112) Sliding space (113) Thread (114) Guide hole (115) Seal body (1151) End of the seal body (1152) Other end of the seal body (12) (12') First component (121) First seat body (122) Insertion groove (13) Second component (131) Second seat body (14) Transmission portion (141) Slide rod (1411) Abutting end (142) Slider (15) Elastic portion (16) Driving portion (161) First bolt (162) Power output shaft (163) Second bolt (17) (17') First acting portion (18) (18') Second acting portion (19) (19') Third acting portion (s) Virtual movement axis

What is claimed is:

1. A removal tool, comprising:

a base portion;

a first component, disposed on the base portion;

a second component, disposed on the base portion, and isolated from the first component;

a transmission portion, transferring a first external force to enable the first component to make a relative movement relative to the second component in an axial direction of a virtual movement axis, to reduce a distance between the first component and the second component; and a first acting portion, a second acting portion, and a third acting portion, respectively disposed on the first component and the second component, wherein the first component is enabled to move between a first position and a second position in a direction different from the axial direction of the virtual movement axis under the effect of a second external force, when the first component is located in the first position, the first acting portion and the second acting portion are isolated from each other in a direction parallel to the axial direction of the virtual movement axis, and when the first component is located in the second position, the first acting portion and the third acting portion are isolated from each other in the direction parallel to the axial direction of the virtual movement axis;

wherein the base portion has a column body, and the first component is slidably sleeved on the column body;

wherein the base portion further comprises a sliding space, extending in the column body along the column axis of the column body, and two guide holes that are coaxial with each other are separately disposed on two sides of the column body in a symmetrical manner and extending along the column axis into elongated holes to be connected to the sliding space.

2. The removal tool according to claim 1, wherein the first acting portion and the second acting portion are separately disposed on the first component, and the third acting portion is disposed on the second component.

3. The removal tool according to claim 2, wherein the first acting portion and the second acting portion have fork-shaped bodies, and are disposed on the first component or the second component protruding with forking directions of the first acting portion and the second acting portion opposite each other.

4. The removal tool according to claim 2, wherein the third acting portion is a sheet-shaped blocking body and is protrusively disposed on the first component or the second component.

5. The removal tool according to claim 1, wherein the first acting portion and the second acting portion are separately disposed on the second component, and the third acting portion is disposed on the first component.

6. The removal tool according to claim 5, wherein the first acting portion and the second acting portion have fork-shaped bodies, and are disposed on the first component or the second component protruding with forking directions of the first acting portion and the second acting portion opposite each other.

7. The removal tool according to claim 5, wherein the third acting portion is a sheet-shaped blocking body and is protrusively disposed on the first component or the second component.

8. The removal tool according to claim 1, wherein the first component is slidably disposed on the base portion, and is capable of making a reciprocal linear movement along the virtual movement axis.

9. The removal tool according to claim 1, wherein the first component is movably disposed on the base portion, and is capable of moving between the first position and the second position in a direction perpendicular to the virtual movement axis.

10. The removal tool according to claim 1, wherein the second component is disposed at an end of a column axis of the column body in a positioned manner.

11. The removal tool according to claim 1, wherein the transmission portion is slidably disposed in the sliding space, and has two abutting ends, respectively protruding from the guide holes of the column body and abutting a side, opposite the second component, of the first component.

12. The removal tool according to claim 11, wherein the transmission portion further comprises a slider slidably disposed in the sliding space, and a slide rod is slidably disposed in the sliding space with the abutting ends formed at two ends of a rod shaft and is adjacent to the slider.

13. The removal tool according to claim 11, wherein the first component has a first seat body, two insertion grooves are separately provided on the first seat body, and the abutting ends are respectively inserted in the two first insertion grooves.

14. The removal tool according to claim 1, further comprising an elastic portion, located between the first component and the second component, and used to provide an elastic force to elastically keep the distance between the first component and the second component and keep the first component between the elastic portion and the transmission portion.

15. The removal tool according to claim 14, wherein the elastic portion is a spring.

16. A removal tool, comprising:

a base portion;

a first component, disposed on the base portion;

a second component, disposed on the base portion, and isolated from the first component;

a transmission portion, transferring a first external force to enable the first component to make a relative movement relative to the second component in an axial direction of a virtual movement axis, to reduce a distance between the first component and the second component;

a first acting portion, a second acting portion, and a third acting portion, respectively disposed on the first component and the second component, wherein the first component is enabled to move between a first position and a second position in a direction different from the axial direction of the virtual movement axis under the effect of a second external force, when the first component is located in the first position, the first acting portion and the second acting portion are isolated from each other in a direction parallel to the axial direction of the virtual movement axis, and when the first component is located in the second position, the first acting portion and the third acting portion are isolated from each other in the direction parallel to the axial direction of the virtual movement axis; and a driving portion, disposed on the base portion, and providing the first external force via the transmission portion, wherein the base portion has a column body, a sliding space extends in the column body along a column axis of the column body, and a thread is disposed annularly on a wall of the sliding space; and wherein the driving portion has a first bolt, an end of a rod shaft enters the sliding space and is screwed to the thread with a circumference, a power output shaft protrudes from an end, located in the sliding space, of the first bolt, an end of the power output shaft abuts the transmission portion, a second bolt is coaxially screwed in the first bolt and used to drive the power output shaft to make a reciprocal axial movement.

* * * * *